US006758749B2

(12) United States Patent
Krintzman

(10) Patent No.: US 6,758,749 B2
(45) **Date of Patent: *Jul. 6, 2004**

(54) ENHANCED PAYOUT FEATURE FOR GAMING MACHINES

(75) Inventor: Jeffrey S. Krintzman, Reno, NV (US)

(73) Assignee: Radical Gaming Concepts Ltd., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 336 days.

(21) Appl. No.: 09/127,183

(22) Filed: Jul. 31, 1998

(65) Prior Publication Data

US 2002/0006822 A1 Jan. 17, 2002

(51) Int. Cl.[7] ..... A63F 9/24
(52) U.S. Cl. ..... 463/25
(58) Field of Search ..... 463/16–22, 25, 463/26, 27, 40, 41, 42; 273/143 R, 138.1

(56) References Cited

U.S. PATENT DOCUMENTS 4,363,485 A * 12/1982 Edwall ..... 273/121 A
4,448,417 A * 5/1984 Clark et al. ..... 273/121 A
4,504,062 A * 3/1985 Smith, III et al. ..... 273/313
5,257,179 A * 10/1993 DeMar
5,267,734 A * 12/1993 Stamper et al.
5,370,306 A * 12/1994 Schulze et al.
5,496,030 A * 3/1996 Fernandez ..... 273/121 A
5,533,727 A * 7/1996 DeMar
5,542,669 A * 8/1996 Charron et al.
5,752,882 A 5/1998 Acres et al.
5,772,509 A 6/1998 Weiss
5,823,874 A 10/1998 Adams
5,848,932 A 12/1998 Adams
5,992,848 A * 11/1999 Krutsch et al. ..... 273/121 A
6,059,288 A * 5/2000 Popadiuk et al. ..... 273/121 A

FOREIGN PATENT DOCUMENTS

GB 2211975 * 7/1989
GB 2229565 * 9/1990

* cited by examiner

*Primary Examiner*—Rinaldi I. Rada
*Assistant Examiner*—John Paradiso

(57) ABSTRACT

A gaming machine of the type that disgorges a payout is provided a signal that defines an enhanced payout interval of selective duration. A count down display provides a visual and/or audible indication of the time remaining for the enhanced payout interval. The machine disgorges an enhanced payout in concurrent response to the signal and a payout event. In one embodiment, a signal generator periodically provides a timing pulse to the gaming machine of a duration that comprises the enhanced payout interval. When a payout event occurs during the enhanced payout interval, the machine disgorges an enhanced payout. The enhanced payout may be inhibited when the coin in of the machine between timing pulses is less than a predetermined amount. In another embodiment, clock pulses increment an activity counter during a pre-selected activity interval. The enhanced payout signal may be provided to the gaming machine after the activity interval. Should coin in not occur in sufficient frequency or amount during the activity interval, the activity counter is reset, thereby preventing the enhanced payout.

15 Claims, 4 Drawing Sheets

ENHANCED PAYOUT FEATURE FOR GAMING MACHINES

BACKGROUND OF THE INVENTION

1. Field of Invention

This invention generally relates to gaming machines and, more particularly, to an enhanced payout feature therefor. More specifically, this invention relates to a gaming machine that disgorges an enhanced payout in response to a payout event occurring during an enhanced payout interval.

2. Description of the Prior Art

In areas where gaming is permitted, gaming machines, such as slot, bingo, keno, and video poker machines, as well as many other electronic, mechanical and video gaming devices, have relegated table games to an also-ran status. A great influx of persons new to gaming have been almost exclusively attracted to gaming machines. They are simple to operate and are less intimidating than table games, which demand quick interaction with a dealer and other persons during the course of play.

In the state of Nevada, for example, almost 5 billion dollars per year is spent on gaming machine play. Even those businesses operating under limited gaming licenses, such as grocery stores, restaurants, bars, and convenience stores, often derive a substantial portion of their revenue from the play of slot and video poker machines.

Traditionally, a gaming machine is a stand-alone device that is played after a player inserts one or more coins or other currency equivalent into the machine. Once activated, the play usually comprises either pushing a button, pulling a lever, or touching a screen where a video image is displayed. The outcome of play is then displayed on the machine, which is typically a final position of spinning wheels (or their electronic equivalent) of the gaming machine, or a display of an image of playing cards. This outcome is compared to a win table of values to determine whether or not the player has won, and, if so, how much. The majority of wins are paid by disgorgement of coins by the machine itself.

The amount of money that the player inserts is termed the "coin in" of the machine. The amount retained within the machine, i.e., not paid out, is termed the "hold." With the exception of games such as video poker and video blackjack, the "skill" of the player has no effect on the machine outcome. However, even with video poker and video blackjack, a highly skilled player is at a statistical disadvantage. For machine owners seeking increased profitability, the strategy has been to generate increased play of the machine.

A number of techniques have been developed that are intended to increase the amount of machine play. Placing certain types of designs on a glass portion of a casing of the machine, for example, has resulted in increased play. Additionally, "high-tech" design features of a machine such as the wheel in the well known Wheel of Fortune™ game and video displays have been developed to increase play. Such simple strategies as relocating game machines to vary traffic patterns has also proven effective in increasing play.

An alternate way in which the play of gaming machines is increased, particularly in a casino, is having an employee of the casino make an announcement that for a specified time period, the next three minutes, for example, all payouts would be doubled. The three minutes is referred to as an enhanced payout interval. During this enhanced payout interval, all machine payouts (or payouts for specifically-identified payout events) are augmented by an additional payout given by the casino employee. During the enhanced payout interval, the player will receive a doubled (or more) payout.

Such announcements are typically made at the will and whim of a casino operator. When conducted on such a catch-as-catch-can basis, it is difficult to ascertain whether the increase in the coin in during the enhanced payout interval has any long term beneficial effect on the overall amount of coin in. Also, this oftentimes, haphazard use of the enhanced payout strategy makes it difficult to optimize "coin in" analysis for such variables as duration and time of occurrence for the enhanced payout interval.

Because the announcements and the augmented payouts are not automated, use of the enhanced payout brings with it increased staffing costs. One or more employees of the casino are required to be present to make the announcements and augment and verify the payouts.

The press of other duties of casino employees frequently necessitates the delay and/or postponement of the enhanced payout interval. This further confounds the ability to conduct a long-term analysis regarding benefits of the enhanced payout.

It is therefore important that an enhanced payout procedure be automated to the extent practical. Ideally, the gaming machine itself is able to control the frequency of the enhanced payout intervals based upon either the coin in or upon a command from the casino operator. The occurrence of the enhanced payout interval is preferably either random or pseudo-random to prevent its accurate anticipation by the player. Such randomness will encourage a maximization of play at times other than during the enhanced payout interval.

Preferably, the player is also provided an indication of the time remaining within the enhanced payout interval. By so doing, a sense of urgency is established, resulting in a player attempting to maximize play of the machine during an ever-decreasing period of time. Additionally, except for perhaps a payout for a jackpot event, the machine will itself disgorge any enhanced payout(s) obtained during the enhanced payout interval.

Finally, there is a need for tying the enhanced payout interval to a progressive jackpot machine where the player must insert a "premium bet" to be eligible to win a jackpot payout. The requirement that this premium bet be made for jackpot eligibility is preferably eliminated during the enhanced payout interval, thereby encouraging an increased play of the progressive machine. It should be understood that the enhanced payout interval may be provided simultaneously for a number of progressive jackpot machines.

SUMMARY OF THE INVENTION

These and other problems of gaming machines are successfully addressed by the present invention.

There is an obvious need to automate the process for many reasons including, labor savings, accuracy, bookkeeping, statistical information and security. Admittedly though, the ultimate goal is to increase the customer's coin in, and enhance the player's gaming experience.

The apparent simplicity of the timed jackpot feature should enable games to get to market quickly, with a minimum amount of development. It is also possible that a retrofit package may be developed and marketed to enhance legacy machines that currently lack video or other display capability. The concept is applicable across the entire product line of a company that employs adequate technology to support the feature. A progressive bank of slot machines, wide area linked progressive system, or stand alone theme game are obvious choices for an enhancement with a "BEAT THE CLOCK™" feature.

Due to the high hit frequency of a poker machine, the doubling of winning hands from Three of a Kind through Royal Flush is used in the following example. A 5/7 Bonus Poker game's theoretical par would be approximately 3.5% under the following conditions:

a) Double Jackpot period occurs 4 times per hour;

b) Period lasts for 15 seconds each time;

c) Three of a kind through Royal Flush are eligible for doubled awards. (Pair & 2 pair pay normally);

d) In real world applications, the players will speed up their play during the "Double Time", to get in the maximum number of hands possible during the double period, probably reducing their own effectiveness, thereby increasing the game's mathematical hold %;

e) It may be advisable to reduce paytable awards in order to increase the frequency and duration of the feature. This should be easily accomplished with newer microprocessor technology, allowing the operator a complete customization of the feature. The expected and actual field return can be computed by the machine's software depending on the various factors selected;

f) A randomly selected "multiplier" ×1, ×2, ×3 could be used instead of a standard doubling of the award, during the enhanced Jackpot period; and g) A higher frequency of enhanced jackpot period intervals with longer time periods can be achieved by placing the jackpot enhancement feature on games with a lower hit frequency such as: Reel Spinning Games, Keno, Bingo, Video Slots, etc.

The notion of a patron waiting for the enhanced jackpot period to begin before playing can be handled using resources already present in current machine platforms. The system clock and coin in pulses can be used to monitor player activity, and either allow the beginning of the enhanced jackpot period or inhibit it, relative to the number of coins played in a period of time etc. Once the event timer has begun, the period should be allowed to occur RANDOMLY during a chosen time frame. These functions could also be provided by an outboard controller device.

In a possible embodiment, the Enhanced Jackpot Period is initiated as follows:

a) First, a preliminary signal is presented to the player, such as a verbal ("Get ready to Beat the Clock!") plus an on screen visual signal will notify the player of a pending enhanced jackpot event;

b) The screen is cleared and repainted, a voice announces the beginning of an enhanced jackpot period. i.e., "It's time to BEAT THE CLOCK™";

c) A clock, with sound or voice, could appear on the screen above the current display, with the clock ticking down the time available to play during the enhanced period; and d) All enhanced payoffs could be displayed with "pulsating and growing" animation or the like. A cheer could sound with each "hit" during the enhanced jackpot period.

A colorfully encased Tic-Tock Clock, (mounted atop the game cabinet) ornamental candle, or free standing sign, could also signal the beginning of the enhanced Jackpot period, in conjunction with the machine's video display and sound to serve as an attract mode for other customers in the casino.

The effect in multiple machine banks should intensify in a similar fashion to that in IGT's Wheel of Fortune™ games, where patron interaction with each other's winning spins enhances play action and coin in. The effect is similar to a patron currently being dealt four cards to a Royal Flush: if he/she announces the "pending opportunity", the adjacent players cheer the player on.

Current technology would allow the casino to custom tailor their own "BEAT THE CLOCK™" award program as to frequency, duration and paytable. Casinos should be encouraged to lock the card cage and disconnect the "privileged option" jumper to prevent tampering. A programmable logic array, custom coded for each casino would serve well instead of a "privileged option key".

A reel (or video reel) spinning slot is ideally suited to the BEAT THE CLOCK™ feature. By increasing the number of stops and maintaining a reasonable hit frequency, the duration and frequency of the "Enhanced Jackpot Period" can be increased, thereby adding to the player appeal of a BEAT THE CLOCK™ feature, while maintaining an acceptable hold percentage for the casino.

One variation would allow the enhanced period to be treated like a multiplier. For example when the clock countdown begins, the game awards might be ×1, ×2, ×3, etc., depending on a random selection of the multiplier value—or, perhaps the multiplier would vary the amount of time in the bonus period (10 seconds ×1, ×2 or ×3 etc.).

Other variations could permit different amounts of bonus play time to be selected at random by the game logic, or might permit a "bonus period" to begin whenever a bonus reel symbol appears in a particular position on the payline. The prospects for jackpot enhancements using "BEAT THE CLOCK™ features are virtually limitless!

For example, this concept also can be applied to a "system game", either as a new series or as an additional feature to existing games. Beginning with a game cabinet similar to the current games with a wheel mounted in the upper unit, a colorful mechanical "Ticktock Clock" could be substituted for the Wheel. When the enhanced jackpot period is triggered by the game logic, or perhaps communication from a Host computer or outboard controller, the clock would begin running backwards (counting down), with amplified ticktock sounds, voice, and/or music. All awards hit during the enhanced period would be bonused.

The machine's top award would be a normal pay during a non-bonused time period, however; the System Progressive could be awarded if the top award were hit during a "BEAT THE CLOCK™ Cycle." The clock would count backwards until it reaches zero, for enhanced play, the enhanced bonus period would end with an audible fanfare. The clock could stop at the moment of "a hit" which would provide visual proof of the bonus award with appropriate sound effects. The clock could also be stopped during the "racking up" of a winner's credits (and started again after the conclusion). This would add the illusion of more bonus time, without adding a net increase in duration of the event . If a primary jackpot scenario were not mathematically feasible, a secondary jackpot that incorporates the enhanced time interval feature would also serve the purpose.

Should the gaming authorities in the various jurisdictions allow "2 way communication" from the host computer in wide area progressives, numerous opportunities would be available. In such a scenario, the host computer could be used to initiate the bonus period throughout the system (in conjunction with an inhibiting feature preventing customers from playing only during the bonus period).

The current crop of "high tech" machine platforms appears to lend itself to this type of concept. Additionally, the enhanced jackpot feature adapts itself easily to games with a built-in display capability. The traditional reel slot can be enhanced via a retrofit kit, (mounting of a display in the upper unit of the game for exhibition of the paytable and enhanced jackpot.)

While a small representation of the concept's potential implementations is presented herein, the opportunities and variations for the feature are boundless. Historically, games with a short learning curve for the player have the greatest chance for success. Games that have features that players instantly recognize and understand, have universal appeal and are easy to relate to. Most adults can fully relate to having to "BEAT THE CLOCK™" in every-day life, and thus will be attracted to games that employ the feature.

Modern gaming machines utilizing the "BEAT THE CLOCK™" bonus enhancement features will continue to amplify coin in and player appeal of the current crop of "$2^{nd}$ feature games" in both video and reel spinning applications.

An object of the present invention is to provide players of gaming machines with an opportunity to play against a time keeping device that defines a time period of enhanced payouts.

A further object of the present invention is to increase the coin in of a gaming machine.

According to one embodiment of the present invention, a gaming machine is of a type that makes a payout when play of the machine results in a payout event. The machine is provided a timing signal that has a duration of an enhanced payout interval. In concurrent response to the timing signal and the payout event, the machine makes an enhanced payout. Additionally, an indicator provides an indication to the player of the time remaining of the enhanced payout interval.

In another embodiment, clock pulses increment an activity counter during an activity interval. An enhanced payout signal may be provided to the machine during an enhanced payout interval after the activity interval. The machine makes an enhanced payout when play of the machine results in a payout event during the enhanced payout interval. However, when either the machine has been idle for a predetermined idle time during the activity interval or the coin in is less than a predetermined amount after the activity interval, the activity interval counter is reset, thereby preventing the enhanced payout.

The present invention provides, as a secondary feature, a representation of decreasing time against which to play for enhanced payout(s), which in turn creates excitement among players of the gaming machine that results in an increase in coin in.

Other objects, features, and advantages of the invention should be apparent from the following description of the embodiments thereof as illustrated in the accompanying drawings. Additionally, it is to be understood and appreciated that the description is for the purpose of fully disclosing the embodiments without placing limitations on the invention.

DETAILED DESCRIPTION OF THE PREFERRED EMBODIMENTS

Figure 1:
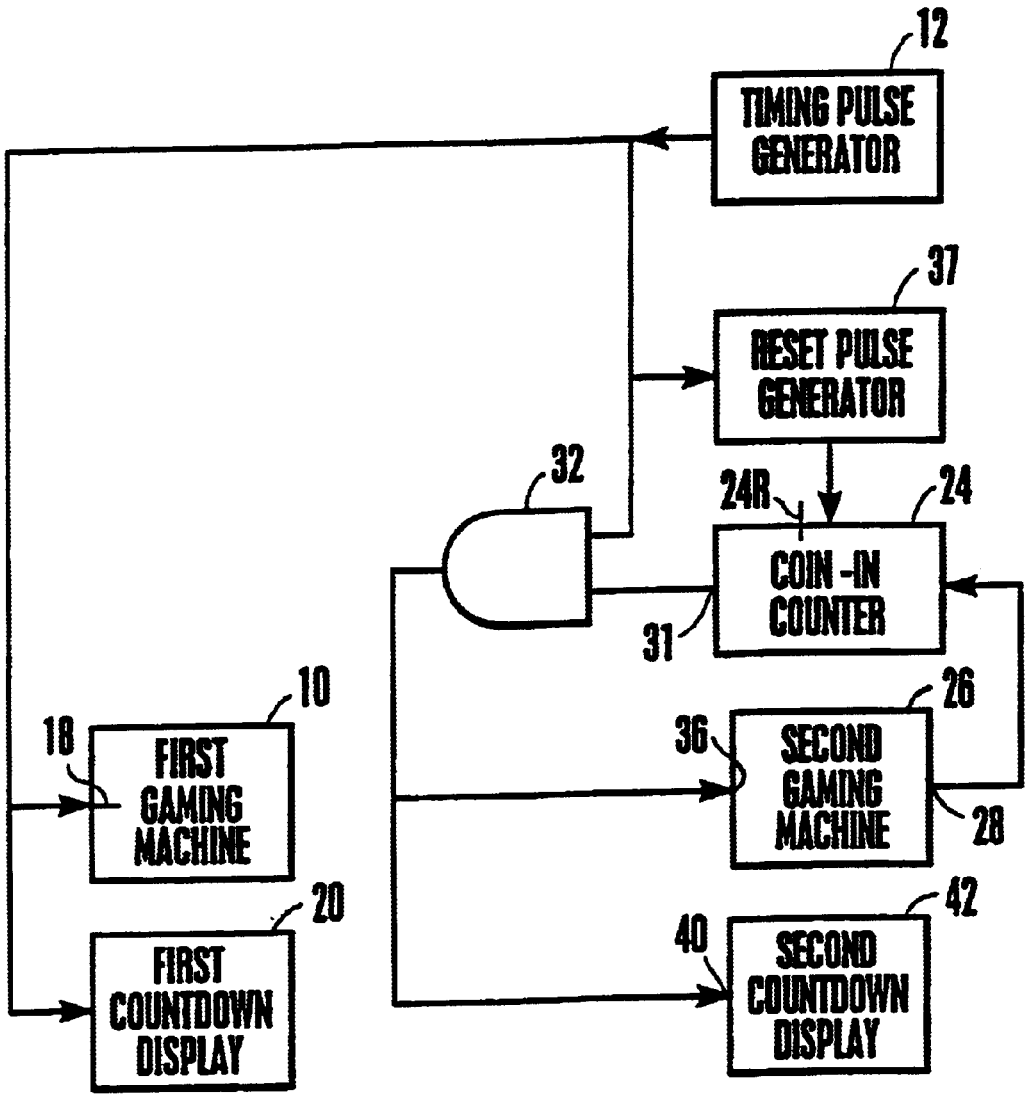
FIG. 1 is a schematic block diagram of a first embodiment of the present invention.

Reference is now made to the drawings, wherein like numerals refer to like elements throughout. As shown in FIG. 1, in a first embodiment of the present invention, initiation of play in a gaming machine (not shown) occurs upon the insertion of currency or currency equivalent by a player (not shown).

It should be understood that in many machines the accepted currency may take many or multiple forms, including coinage, paper money, script representative of currency and/or accumulated credits. In order to simplify an explanation of the present invention, play of a first gaming machine 10 is initiated by insertion of a coin therein.

Play of the first gaming machine 10 has an end result that is compared to a schedule of payout events. When the end result is identified as a payout event, the player is entitled to a payout. Until recently, all but the largest payouts were made by the first gaming machine 10 in the form of disgorged coins. More recently, payout takes the form of "credits" that may be used to initiate further play or be converted to coins and disgorged.

Figure 2:
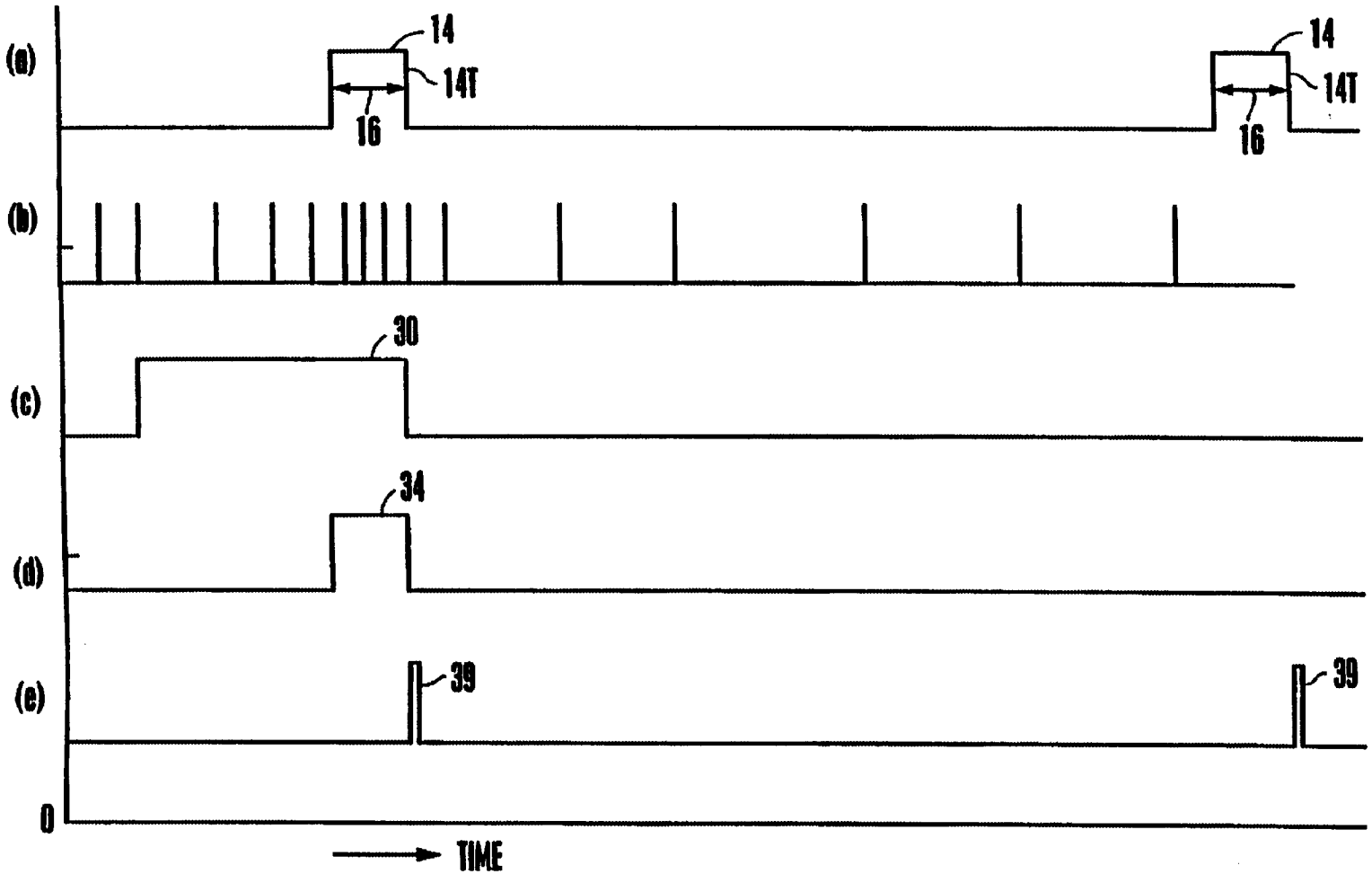
FIG. 2 is a showing of waveforms, all on the same time base, of signals in the embodiment of FIG. 1.

A timing pulse generator 12 periodically generates a timing pulse 14 (see FIG. 2(*a*)). The duration of the timing pulse 14 is referred to as an enhanced payout interval 16. The timing pulse generator 12 is connected to an input 18 of the first gaming machine 10, enabling the timing pulse 14 to be provided to the first gaming machine 10.

For purposes of explanation and not limitation, in this embodiment the enhanced payout interval 16 is twenty seconds, and the timing pulse 14 is provided once every hour. It is to be understood and appreciated that in a preferred embodiment, the timing pulse generator 12 is of a type that may be adjusted by a host of the first gaming machine 10, permitting a selected variance in all aspects of the timing pulse 14.

It also should be understood that the timing pulse generator 12 has a capability of providing the timing pulse 14 simultaneously to a plurality of differing types of gaming machines. Timing pulse generators are well known to those skilled in the art.

In concurrent response to the timing pulse 14 and play of the first gaming machine 10 resulting in a payout event, the first gaming machine 10 disgorges an enhanced payout. Preferably, the first gaming machine 10 provides a display (not shown) of a schedule of payouts and enhanced payouts for achievable payout events.

The generator 12 is additionally connected to the input of a first count down unit 20. In response to the timing pulse 14, the unit 20 provides the player with a visual and/or audible indication of the time remaining during the enhanced payout interval 16. The visual indication may be of a light emitting diode numeric unit, and the audible indication preferably includes the sound of a human voice that recites or "counts down" the time remaining for the enhanced payout interval 16.

The visual and audible indication is expected to encourage the player to play the first gaming machine 10 as rapidly as possible during the enhanced payout interval 16. It should be understood that because the timing pulse generator 12 is easily adjustable, the host can vary the length of the enhanced payout interval 16 to optimize aspects of the timing pulse 14.

It is desirable to inhibit the enhanced payout interval 16 when the coin in for a gaming machine accumulates to less than a predetermined amount between successive timing pulses 14. Apparatus that inhibits the initiation of the enhanced payout interval 16 includes a coin in counter 24 that is connected to a second gaming machine 26 at a coin in output 28 thereof.

An insertion of a coin into the second gaming machine 26 causes the coin in output 28 to provide a coin in pulse (see FIG. 2(*b*)) that increments the coin in counter 24. When the coin in counter 24 is incremented to a coin in value that is equal to a predetermined, desired amount, the coin in counter 24 provides an income signal 30 (see FIG. 2(*c*)) at a coin in counter output 31. This feature is intended to prevent players from delaying play of a gaming machine to await its self-initiation of an enhanced payout interval.

The apparatus that inhibits the enhanced payout additionally includes an AND gate 32 that has one of its two inputs connected to the coin in counter output 31. The other input of the AND gate 32 is connected to the output of the timing pulse generator 12. Accordingly, the income signal 30 and the timing pulse 14 (see FIG. 2) are provided to the AND gate 32.

In concurrent response to the income signal 30 and the timing pulse 14, the AND gate 32 provides an enhanced payout pulse 34 (see FIG. 2(*d*)) to an enhanced payout pulse input 36 of the second gaming machine 26. Upon receiving the enhanced payout pulse 34 concurrently with the occurrence of a payout event, the second gaming machine 26 disgorges an enhanced payout.

Whenever the coin in counter 24 does not provide the income signal 30, the AND gate 32 does not provide the enhanced payout pulse 34, thereby inhibiting the enhanced payout. Hence, when the coin in of the second gaming machine 26 does not equal or exceed a predetermined coin in amount due to insufficient play, the enhanced payout pulse 34 does not occur.

The timing pulse generator 12 is additionally connected to a reset pulse generator 38 at a reset pulse input 37. In response to a timing pulse trailing edge 14T (see FIG. 2(*a*)), the reset pulse generator 38 generates a reset pulse 39 (see FIG. 2(*e*)). The output of the reset pulse generator 38 is connected to a reset coin in counter input 24R of the coin in counter 24. In response to the reset pulse 39, the coin in counter 24 is reset to zero. Such re-setting of a counter is well known to those skilled in the art.

The output of the AND gate 32 is additionally connected to a second count down unit 42 at an input 40. The units 20, 42 are similar in function.

In response to the enhanced payout pulse 34, the second count down unit 42 provides the player with visual and/or audible signals regarding the time interval remaining of the enhanced payout period. The duration of the enhanced payout pulse 34 substantially equals the enhanced payout interval 16.

The gaming machines 10, 26 may alternatively be a progressive jackpot gaming machine wherein a player may insert a separate, jackpot eligibility premium in addition to the currency required to initiate play of the gaming machine as previously described. The act of inserting the jackpot premium qualifies the player to win a jackpot should a jackpot event result from the next play of the gaming machine. Typically, a portion of each jackpot premium inserted in the machine is accumulated to amass the jackpot.

Under an embodiment of the present invention, the insertion of the jackpot premium as a requirement for jackpot eligibility is alternatively satisfied by the timing pulse 14. A player would thereby win a jackpot in concurrent response to a jackpot event and the timing pulse 14.

In a second embodiment of the present invention, a gaming machine makes an enhanced payout when three conditions are met.

A first condition is the amount of coin in during an activity interval being greater than a predetermined minimum. A typical activity interval has been suggested to be twenty minutes which is a maximum of three complete activity intervals per hour.

A second condition requires the time between coins inserted into the gaming machine during the activity interval discussed above be less than a specific idle time. A typical idle time has been suggested to be one minute.

A third condition is the occurrence of a payout event during an enhanced payout interval that follows the activity interval. A typical enhanced payout interval has been suggested to be twenty seconds.

Figure 3:
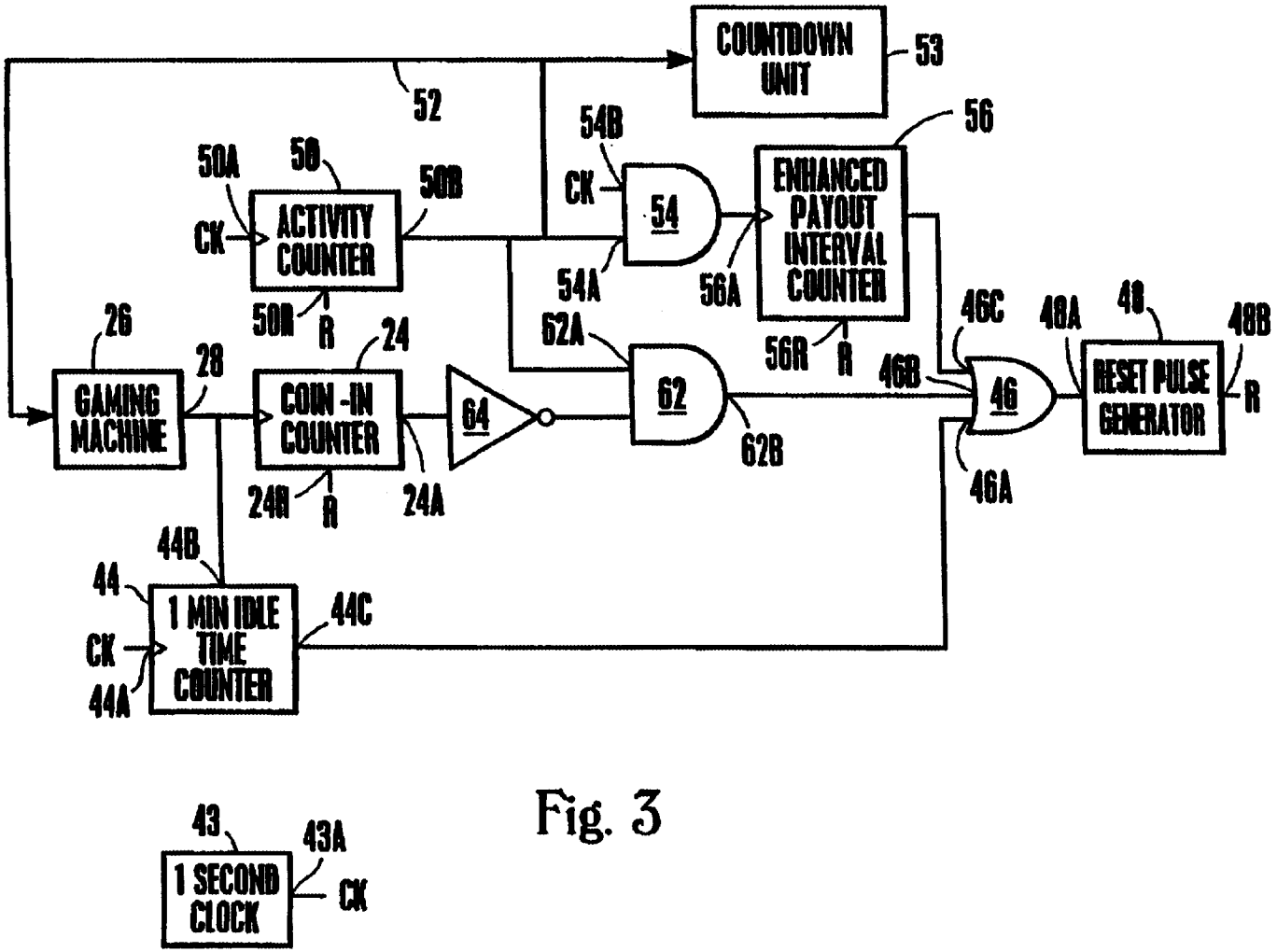
FIG. 3 is a schematic block diagram of a second embodiment of the present invention.
Figure 4:
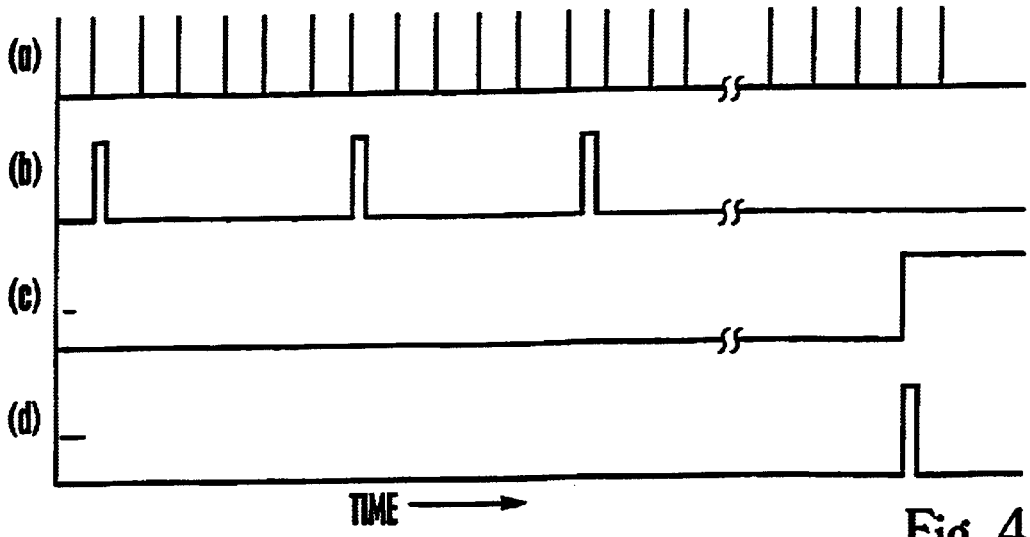
FIG. 4 is a showing of waveforms, all on the same time base, associated with an idle period of a gaming machine having the embodiment of FIG. 3.

As shown in FIG. 3, the second embodiment includes a clock 43 that provides one pulse per second at a clock output 43A (see FIG. 4(*a*)). The clock output 43A is connected to a one minute idle time counter 44 at a counter input 44A. A reset counter input 44B of the idle time counter 44 is connected to the coin in output 28 described in the first embodiment. As so arranged, the idle time counter 44 is incremented in response to a clock pulse and is reset in response to a coin in pulse (see FIG. 4(*b*)). An idle time output 44C of the idle time counter 44 provides an idle time output signal (see FIG. 4(*c*)) in response to being incremented during an idle time of one minute without being reset.

The idle time output 44C is connected to an OR gate 46 at an input 46A. The output of the OR gate 46 is connected to a reset pulse generator 48 at an input 48A. When the idle time counter 44 provides the idle time output signal (see FIG. 4(*c*)), it substantially passes through the OR gate 46. In response to an output of the OR gate 46 caused by the idle time output signal (FIG. 4(*c*)), the reset pulse generator 48 provides a reset pulse (see FIG. 4(*d*)) at an output 48B.

Figure 5:
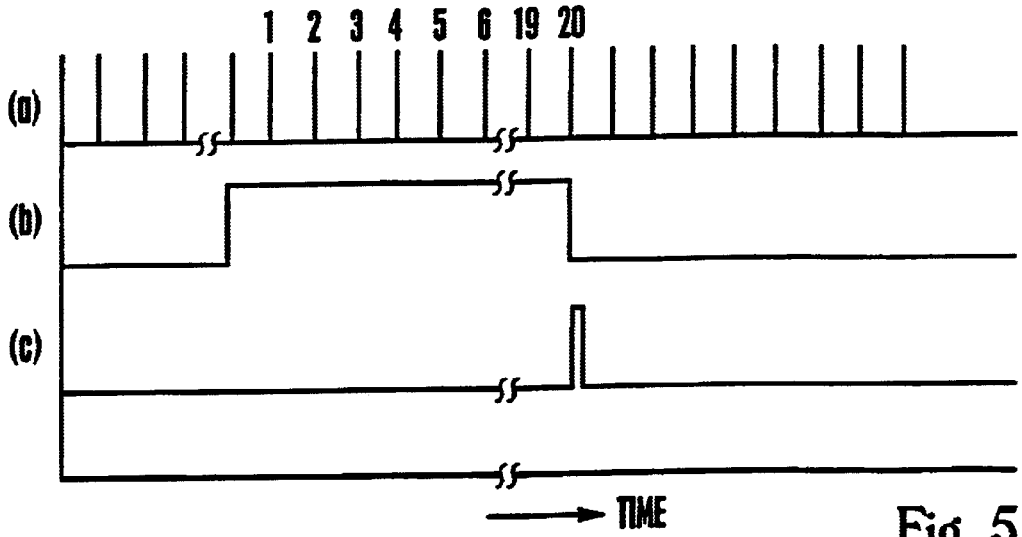
FIG. 5 is a showing of waveforms, all on the same time base, associated with providing an enhanced payout pulse to a gaming machine having the embodiment of FIG. 3.

The clock output 43A is additionally connected to an activity counter 50 at an input 50A. The activity counter 50 is thereby incremented in response to a clock pulse. When clock pulses (see FIG. 5(*a*)) increment the activity counter 50 during an activity interval, such as, by way of example and not limitation, twenty minutes, an enhanced payout signal (see FIG. 5(*b*)) is provided at an output 50B of the activity counter 50. As explained hereinafter, the reset pulse generator 48 provides a reset pulse (see FIG. 5(*c*)) to a reset input 50R of the activity counter 50 to cause the enhanced payout signal to have a twenty-second duration. The twenty second duration is referred to as an enhanced payout interval.

The activity counter output 50B is connected to the gaming machine 26 through a signal line 52. In concurrent response to the enhanced payout signal and play of the gaming machine 26 resulting in a payout event, an enhanced payout is disgorged.

The output 50B is additionally connected to a countdown unit 53 and to a second AND gate 54 at an input 54A. In response to the enhanced payout signal, the count down unit 53 provides a visual and/or audio indication to a player of the time remaining during the enhanced payout interval.

An input 54B of the AND gate 54 is connected to the clock output 43A. The output of the AND gate 54 is connected to an enhanced payout interval counter 56 at a clock input 56A. When the activity signal is provided at the output 50B, the enhanced payout interval counter 56 is incremented at the one pulse per second rate of the clock 43.

Upon being incremented over a pre-selected interval such as, for example, twenty seconds, the enhanced payout interval counter 56 provides a termination signal to an input 46C of the OR gate 46. I he termination signal is substantially passed through the OR gate 46 to the reset pulse generator 48. In response to the termination signal the reset pulse generator 48 generates a reset pulse (see FIG. 5(*c*)). Preferably, the duration of the reset pulse is much less than one second.

The output of the reset pulse generator 4B is connected to the counters 24, 50, 56 at their respective reset inputs 24R, 50R, 56R, whereby the counters 24, 50, 56 are reset by the reset pulse. The resetting of the activity counter 50 establishes the duration of the enhanced payout interval (twenty seconds in the preceding example).

Figure 6:
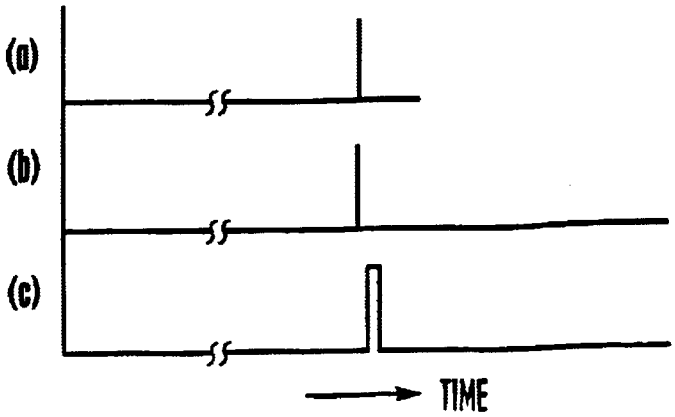
FIG. 6 is a showing of waveshapes, all on the same time base, associated with the coin in of a gaming machine having the embodiment of FIG. 3.

The output 50B is additionally connected to an AND gate 62 at an input 62A. An input 62B of the AND gate 62 is connected to an output 24A of the coin in counter 24 through an INVERTOR 64. An output of the AND gate 62 is connected to an input 46B of the OR gate 46. When the enhanced payout pulse (see FIG. 6(*a*)) is provided by the activity counter 50 and the income signal is not provided to the INVERTER 64, the output of the AND gate 62 substantially passes through the OR gate 46 to cause the reset pulse generator 48 to provide the reset pulse (see FIG. 6(*c*)). Thus, when the amount of currency played, as measured by the coin in counter 24 is less than a predetermined amount at the start of the enhanced payout interval, the reset pulse causes the enhanced payout pulse to be of a vanishingly short duration.

While the invention has been particularly shown and described with reference to embodiments thereof, it should be understood by those skilled in the art that changes in form and detail may be made therein without departing from the spirit and scope of the invention.

I claim:

1. In a gaming machine that makes a payout to a player in response to completion of a play cycle of the machine resulting in a payout event, the improvement comprising:

means for generating an enhanced payout signal at the end of an activity interval during which a frequency of play cycles of the machine is greater than a pre-selected minimum;

means for causing the machine to provide an enhanced payout to the player in concurrent response to said enhanced payout signal and completion of the play cycle of the machine resulting in said payout event; and indicating means for indicating the existence of an enhanced payout interval to the player in response to said enhanced payout signal.

2. The apparatus of claim 1 wherein said indicating means includes a unit that provides a visual indication of remaining time of said enhanced payout interval.

3. The apparatus of claim 1 wherein said indicating means includes a unit that provides an audible indication of remaining time of said enhanced payout interval.

4. The apparatus of claim 1 wherein said indicating means includes a unit that provides both a visual and an audible indication of remaining time of said enhanced payout interval.

5. The apparatus of claim 1 additionally comprising means for inhibiting said enhanced payout interval when coin in of said gaming machine is less than a predetermined amount.

6. The apparatus of claim 1, and further comprising means providing eligibility for a jackpot event upon insertion of a jackpot premium into the machine, said jackpot payout being made in response to play of the machine resulting in a jackpot event.

7. The apparatus of claim 1 wherein said gaming machine is a slot machine.

8. In a gaming machine of a type that provides a signal in response to initiation of a play cycle and makes a payout to a player in response to play of the machine resulting in a payout event, the improvement comprising:

a clock pulse source;

an idle time counter that is incremented in response to a clock pulse and reset in response to initiation of the play cycle, said idle time counter providing an idle time signal in response to being incremented for a known idle time without being reset;

an activity counter that is incremented in response to a clock pulse, said activity counter providing an enhanced payout signal to the gaming machine in response to being incremented, without being reset, during an activity interval;

means for generating a reset pulse, delayed by an enhanced payout interval, in response to said enhanced payout signal;

resetting means for resetting said activity counter in response to said idle time signal and in response to said reset pulse; and indicating means for indicating the existence of said enhanced payout interval to the player in response to said enhanced payout signal.

9. The apparatus of claim 8, and further comprising indicating means for indicating the existence of said enhanced payout interval, and wherein said resetting means comprises a reset pulse generator.

10. The apparatus of claim 9 wherein said indicating means includes a display unit that provides a visual indication of remaining time of the enhanced payout interval in response to said enhanced payout signal.

11. The apparatus of claim 9 wherein said indicating means includes a display unit that provides an audible indication of remaining time of the enhanced payout interval in response to said enhanced payout signal.

12. The apparatus of claim 9 wherein said indicating means includes a display unit that provides both a visual and an audible indication of remaining time of the enhanced payout interval in response to said enhanced payout signal.

13. The apparatus of claim 8 wherein said resetting means includes an enhanced payout interval counter that is incremented in concurrent response to a clock pulse and said enhanced payout signal.

14. The apparatus of claim 8 additionally comprising a coin in counter connected to said resetting means, said coin in counter being incremented in response to an increase of the coin in and providing an income signal when the coin in equals or exceeds a predetermined amount, a reset pulse being provided by said reset pulse generator to said coin in counter, said interval counter and said delay counter in concurrent response to said enhanced payout signal being generated in the absence of said income signal, in response to said interval counter being incremented at the end of an enhanced payout interval and in response to said idle time signal.

15. Apparatus for encouraging an increased play of a gaming machine of a type that makes a payout in response to completion of a machine play cycle resulting in a payout event, the machine making an enhanced payout when the payout event occurs during an enhanced payout interval, comprising:

an idle time counter that is incremented at a known rate and is reset in response to an initiation of the machine play cycle, said idle time counter providing an idle time signal in response to being incremented without reset over a predetermined idle time interval; and means for preventing the enhanced payout interval in response to said idle time signal.

* * * * *